US005667463A

United States Patent [19]

Jones

[11] Patent Number: 5,667,463

[45] Date of Patent: Sep. 16, 1997

[54] EXERCISE MACHINES AND METHODS

[76] Inventor: Arthur A. Jones, 1155 NE. 77th St., Ocala, Fla. 32670

[21] Appl. No.: 947,284

[22] Filed: Sep. 15, 1992

Related U.S. Application Data

[63] Continuation-in-part of Ser. No. 909,658, Jul. 7, 1992, Pat. No. 5,265,125.

[51] Int. Cl.[6] ..... A63B 21/00

[52] U.S. Cl. ..... 482/97; 482/98

[58] Field of Search ..... 482/97–104, 133–138

[56] References Cited

U.S. PATENT DOCUMENTS

| | | | |
|---|---|---|---|
| 3,708,166 | 1/1973 | Annas . | |
| 3,731,922 | 5/1973 | Jungreis | 482/97 X |
| 3,917,262 | 11/1975 | Salkeld . | |
| 4,765,611 | 8/1988 | MacMillan | 482/98 |
| 4,790,530 | 12/1988 | Maag . | |
| 4,834,365 | 5/1989 | Jones | 482/100 |
| 4,838,545 | 6/1989 | Wilson | 482/97 |
| 4,883,270 | 11/1989 | Maag . | |
| 4,917,379 | 4/1990 | Maag . | |
| 4,923,195 | 5/1990 | Calderone . | |
| 4,964,632 | 10/1990 | Rockwell | 482/137 X |
| 5,050,873 | 9/1991 | Jones | 482/97 X |
| 5,135,457 | 8/1992 | Caruso | 482/100 X |

FOREIGN PATENT DOCUMENTS

| | | | |
|---|---|---|---|
| 244070 | 3/1987 | Germany | 482/97 |
| 244071 | 3/1987 | Germany | 482/97 |
| 279412 | 6/1990 | Germany | 482/97 |

OTHER PUBLICATIONS

The Pulldown Latissimus Machine Advertised In Recreation, Sports & Leisure, Sep. 1982, p. 14.

*Primary Examiner*—Richard J. Apley
*Assistant Examiner*—John Mulcahy
*Attorney, Agent, or Firm*—William E. Mouzavires

[57] ABSTRACT

A machine for exercising muscles of the human body which includes a movement arm pivotable about a horizontal axis by the user against a resistance provided by a weight stack. A drive shaft is connected to the movement arm and extends vertically downwardly below the weight stack where it is connected to a lever which in turn is connected to the lower end of a pin included in the weight stack. When the movement arm is rotated and pivoted in one direction it will move the drive shaft and the lever to raise the pin in the weight stack. The weight stack includes upper and lower stacks of weights independently connectable to the stack pin.

12 Claims, 5 Drawing Sheets

EXERCISE MACHINES AND METHODS

RELATED APPLICATIONS

This application is a continuation-in-part of my prior U.S. application Ser. No. 07/909,658, filed Jul. 7, 1992, entitled BICEPS CURL MACHINE, and issued on Oct. 26, 1993 as U.S. Pat. No. 5,265,125.

BACKGROUND OF INVENTION

The present invention generally relates to machines for exercising one or more upper portions of the human body including the arms, shoulders, upper torso, and neck. Numerous machines exist and have been known in the prior art for exercising the aforementioned parts of the human body. Such machines commonly utilize some sort of a movement arm which is moved by the body upon exertion of the muscles to be exercised and against a resistance typically a weight stack. Commonly, the movement arm is connected to the weight stack by an overhead cable and pulley system which increases the height of the machine and also introduces a certain amount of friction in the transmission of the drive thereby reducing efficiency.

An object of the present invention is to provide a novel and improved exercise machine which utilizes a weight stack for resistance to the movement arm but which eliminates the need of an overhead cable and pulley system for transmitting the drive from the movement arm to the weight stack.

A further object of the present invention is to provide novel and improved machines and methods for exercising one or more upper parts of the human body including, for example, the upper torso, shoulders and arms in a manner which is safe and effective. Included herein is the provision of such machines and methods which incorporate an improved drive system for transmitting movement from a movement arm to a weight stack.

SUMMARY OF PREFERRED EMBODIMENT

In summary, the preferred embodiment of the present invention includes a movement arm pivotable about a generally horizontal axis by the user exerting the muscles of the parts of the body to be exercised. The movement arm is connected to a resistance weight stack by a drive rod pivotally connected at its upper end to the movement arm and its lower end to a weight stack pin which extends vertically through the weight stack and is selectively connectable to one or more weights of the weight stack. The connection between the drive rod and the weight stack pin however is effected through a linkage including a main lever having an intermediate portion pivotally connected to the lower end portion of the drive rod. One end of the lever is pivotally connected to the lower portion of the weight stack pin while the opposite end of the lever is pivotally mounted to a stationary support by a link. Pivoting of the movement arm in one direction by the user will, through the lever, raise the weight stack pin and the weight(s) connected to the latter. When the exerciser relieves force on the movement arm, the movement arm will pivot in the opposite direction while the resistance weights descend to the starting position by gravity.

DRAWINGS

Other objects and advantages of the present invention will become apparent from the following detailed description taken in conjunction with the drawings in which.

DETAILED DESCRIPTION

Figure 1:
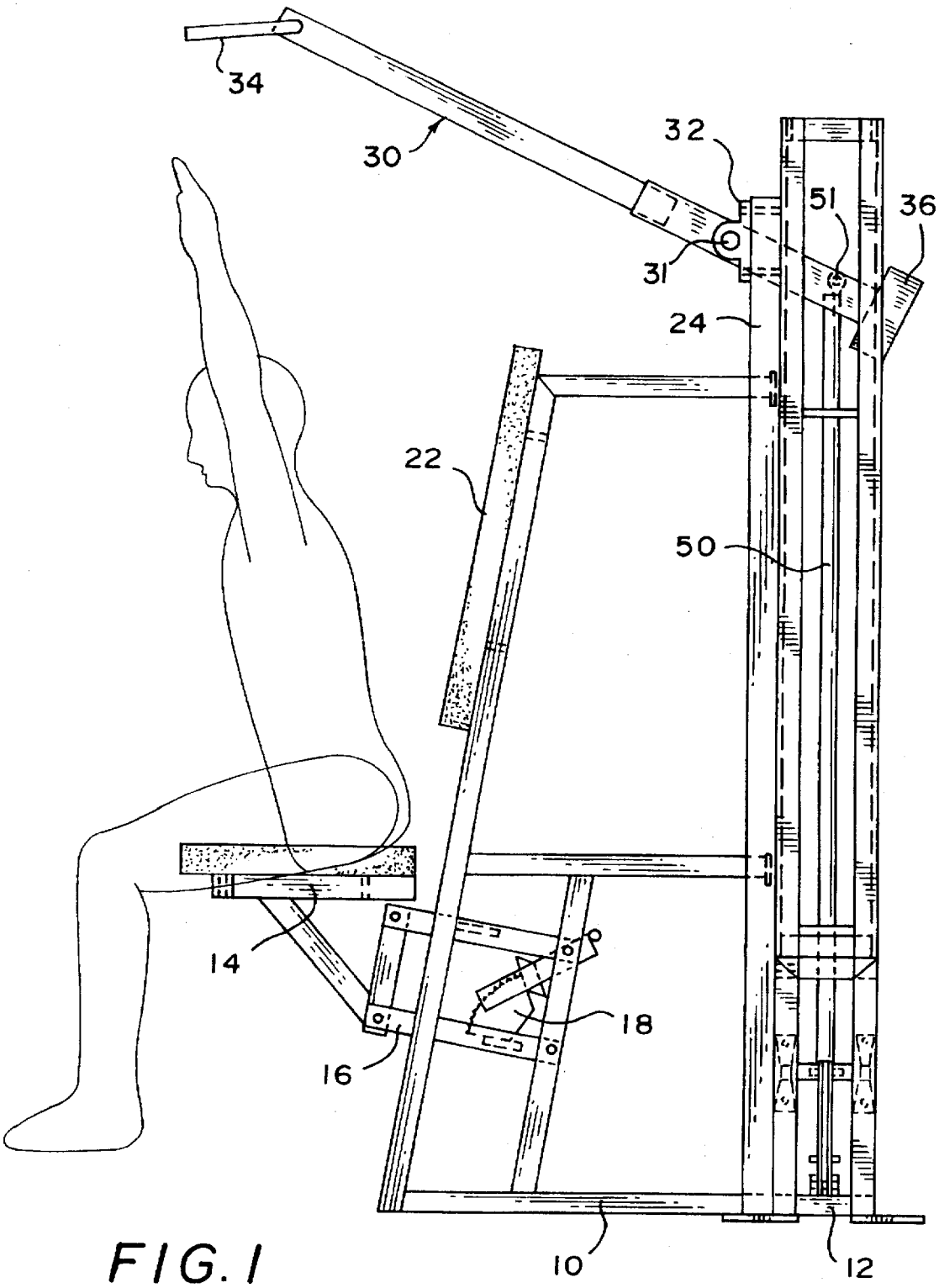
FIG. 1 is an elevational view of one machine embodying the present invention as seen from one end thereof.
Figure 2:
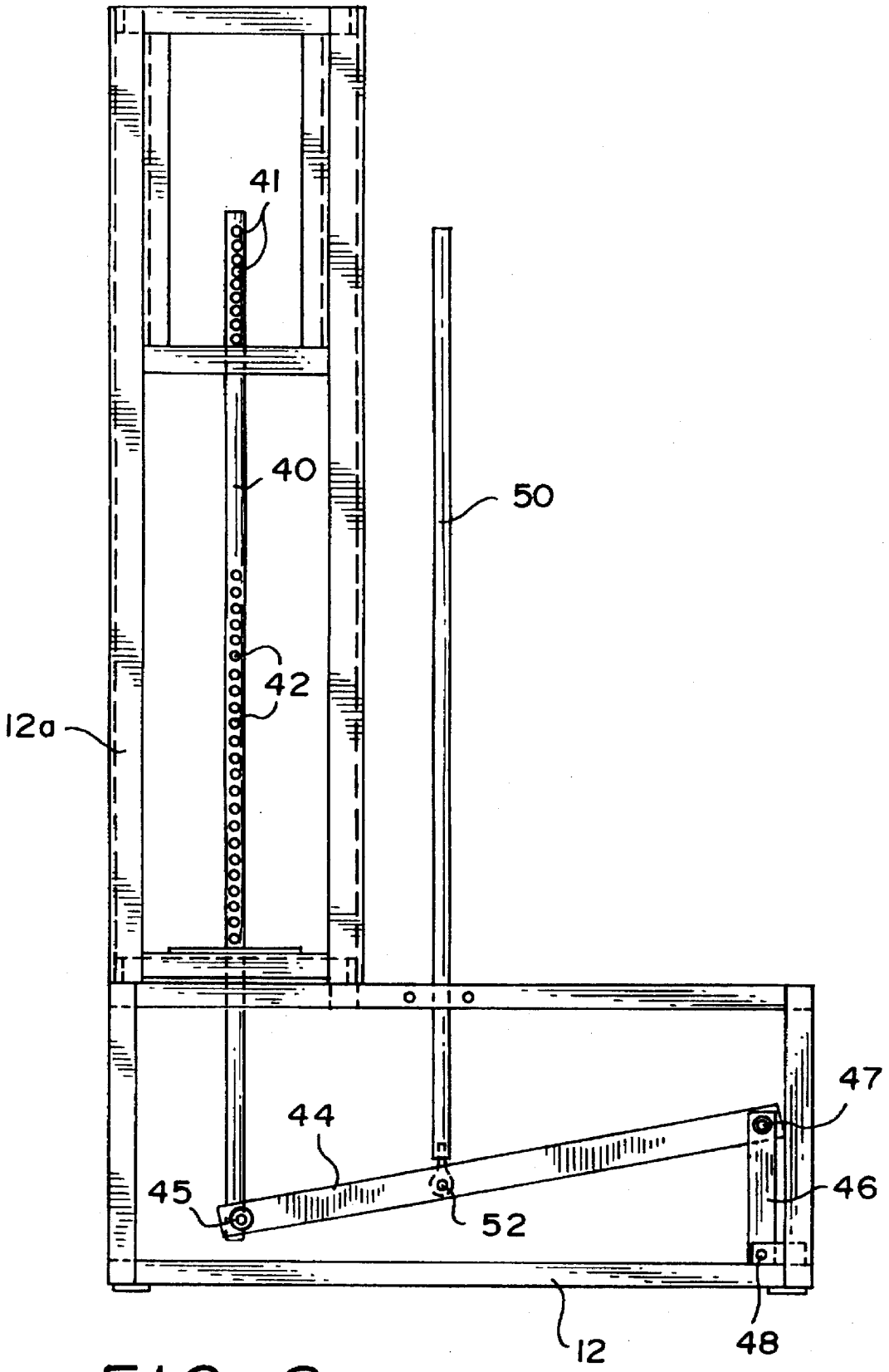
FIG. 2 is a front elevational view of the machine shown in FIG. 1 but with portions removed.
Figure 3:
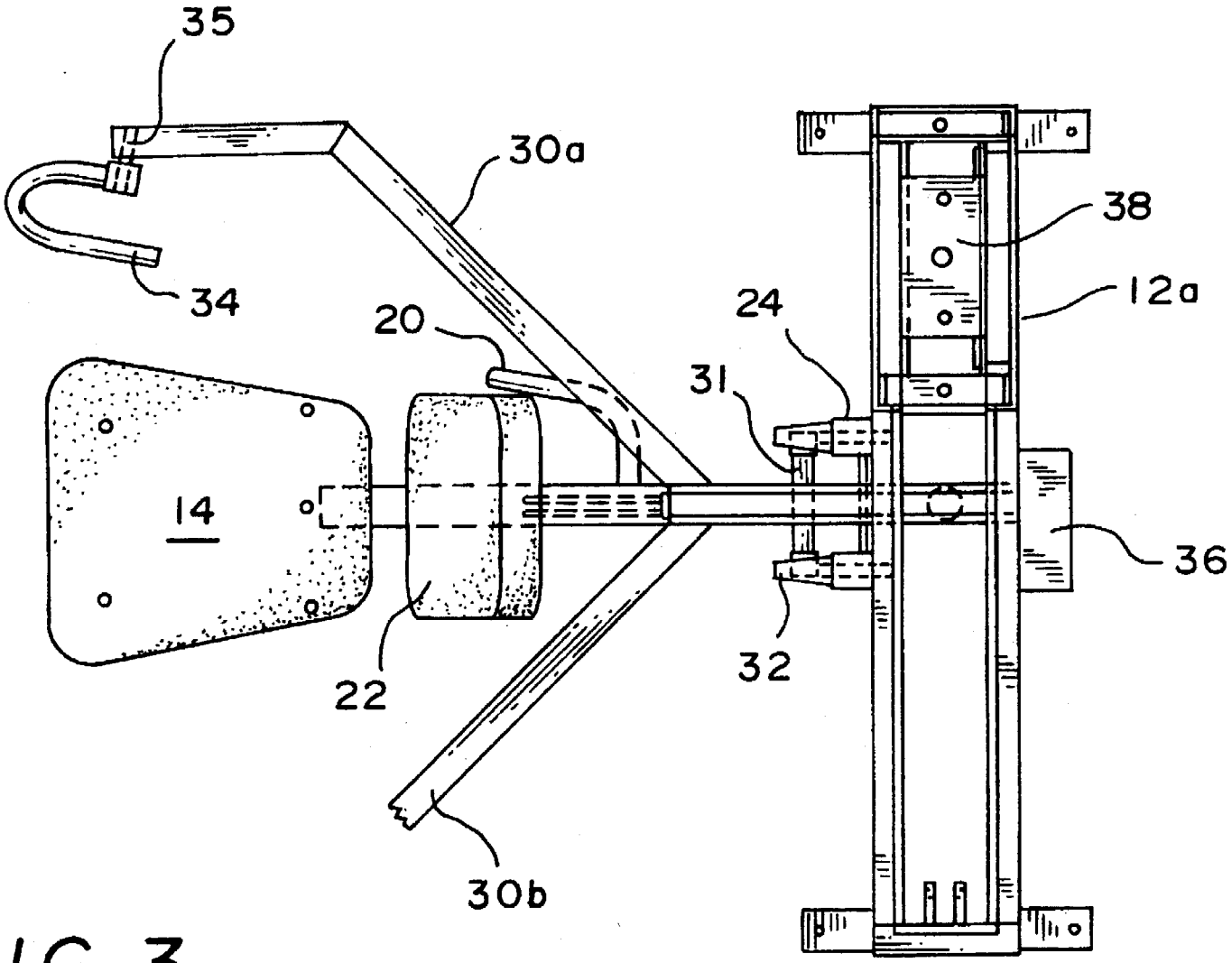
FIG. 3 is a plan view of the machine shown in FIG. 1.

Referring now to the drawings in detail, there is shown for illustrative purposes only in FIGS. 1, 2 and 3, a machine embodying the present invention and which may be termed a "torso arm" machine for exercising muscles of the upper chest, back, arms and shoulders. In the preferred embodiment shown, the machine includes a front frame generally designated 10 and a rear frame generally designated 12 which are made from elongated rails or tubular stock of high strength metallic material, however any other suitable material may be utilized as long as it provides the necessary strength and weight. Front frame 10 includes a seat generally designated 14 mounted to the frame by means of a parallelogram linkage generally designated 16. Linkage 16 is adjustable vertically to change the elevation of the seat 14 to suit the user and once adjusted it is held in place by a latch plate 18 receiving a latch pin which is actuated by means of a handle 20 shown in FIG. 3. Front frame 10 further includes a backrest 22 fixed to upper portions of the front frame as best shown in FIGS. 1 and 3.

To exercise the muscles, the user sits on seat 14 as shown in FIG. 1 and with his arms grasps a movement arm generally designated 30 and lowers the movement arm 30 by pivoting it about a generally horizontal axis shown at 31 in FIG. 1. In the preferred embodiment shown, the movement arm is a yoke arm having arm portions 30*a* and 30*b* converging to a rectilinear portion which is mounted about a pivot shaft 31 which in turn is mounted in bearing blocks 32 fixed to a vertical frame portion 24. The extremities of yoke arms 30*a* and 30*b* are provided with handlebars 34 preferably pivotably mounted about pivot pins 35 to the yoke arms 30*a* and 30*b* as best shown in FIG. 3. Handlebars 34 are thus adjustable about the pivot pins 35 to suit the needs of the user. Movement arm 30 is mounted on the front side of the frame 12, 24 and extends rearwardly of the pivot shaft 31 where it terminates in a counterweight 36 which balances the movement arm relative to its pivotal axis 31.

In accordance with the present invention, a novel drive system is provided to transmit movement of the movement arm 30 to the weight stack. In the preferred embodiment it includes a vertical drive shaft or rod generally designated 50 which is connected at 51 to the movement arm 30 intermediate the ends thereof. Drive rod 50 is elongated and extends to the bottom area of the machine in the rear frame 12 as best shown in FIG. 2 where it is connected to the resistance weight stack by means of a linkage. The latter includes a main link or lever 44 having an intermediate portion pivotally connected by pivot pin 52 to the lower end of drive shaft 50. One end of lever 44 is pivotally connected at pivot pin 45 to the lower end of a stack pin 40 included in the resistance weight stack. The opposite end of the lever 44 is pivotally connected to the stationary frame 12 by means, in the preferred embodiment, of a link 46 having one end pivotally connected by pin 47 to the lever 44 and having an opposite end pivotally connected by pin 48 to the frame 12.

Referring to FIG. 2, it will be seen that when the drive shaft 50 is raised upon downward pivoting of the movement arm 30, this will cause the main link 44 to pivot upwardly to raise stack pin 40. Of course the opposite movement will occur when the drive shaft 50 is lowered when the user relieves force on the movement arm enabling the resistance weights to descend.

Any suitable resistance weight stack may be employed, however in the preferred embodiment a compound weight stack is utilized such as disclosed in my U.S. Pat. No. 4,834,365 entitled COMPOUND WEIGHT SYSTEM. The disclosure of my aforementioned U.S. Pat. No. 4,834,365 as well as my co-pending application Ser. No. 07/909,658 identified above and its parent U.S. Pat. No. 5,149,313 are hereby incorporated by reference into the instant application as part thereof. In the instant embodiment, the compound weight stack includes a frame 12*a* including first and second independent groups of weights, one weight being shown as 38 in FIG. 3. The upper group of weights is connectable to the stack pin 40 through means of apertures 41 which receive pins which extend through the weights in well-known manner. The lower group of weights is connectable in similar manner to the stack pin through means of the apertures 42 shown in FIG. 2.

As best shown in FIG. 1, the movement arm 30 is located a sufficient distance above the seated user so that the arms will be stretched when the movement arm is first grasped. As the user pivots the movement arm downwardly the muscles of the upper chest, backs, arms and shoulders will be exerted to lower the movement arm and overcome the resistance provided by the weights in the weight stack. After the movement arm has been lowered and the user relieves pressure, the weights of the resistance stack will return the movement arm to the raised position while the user continues to hold the handles 34 whereupon the exercise is repeated. In addition to the other advantages, it will also be seen that this machine makes chining-type exercises possible for those individuals who do not have sufficient upper body strength to lift their own body weight.

Figure 4:
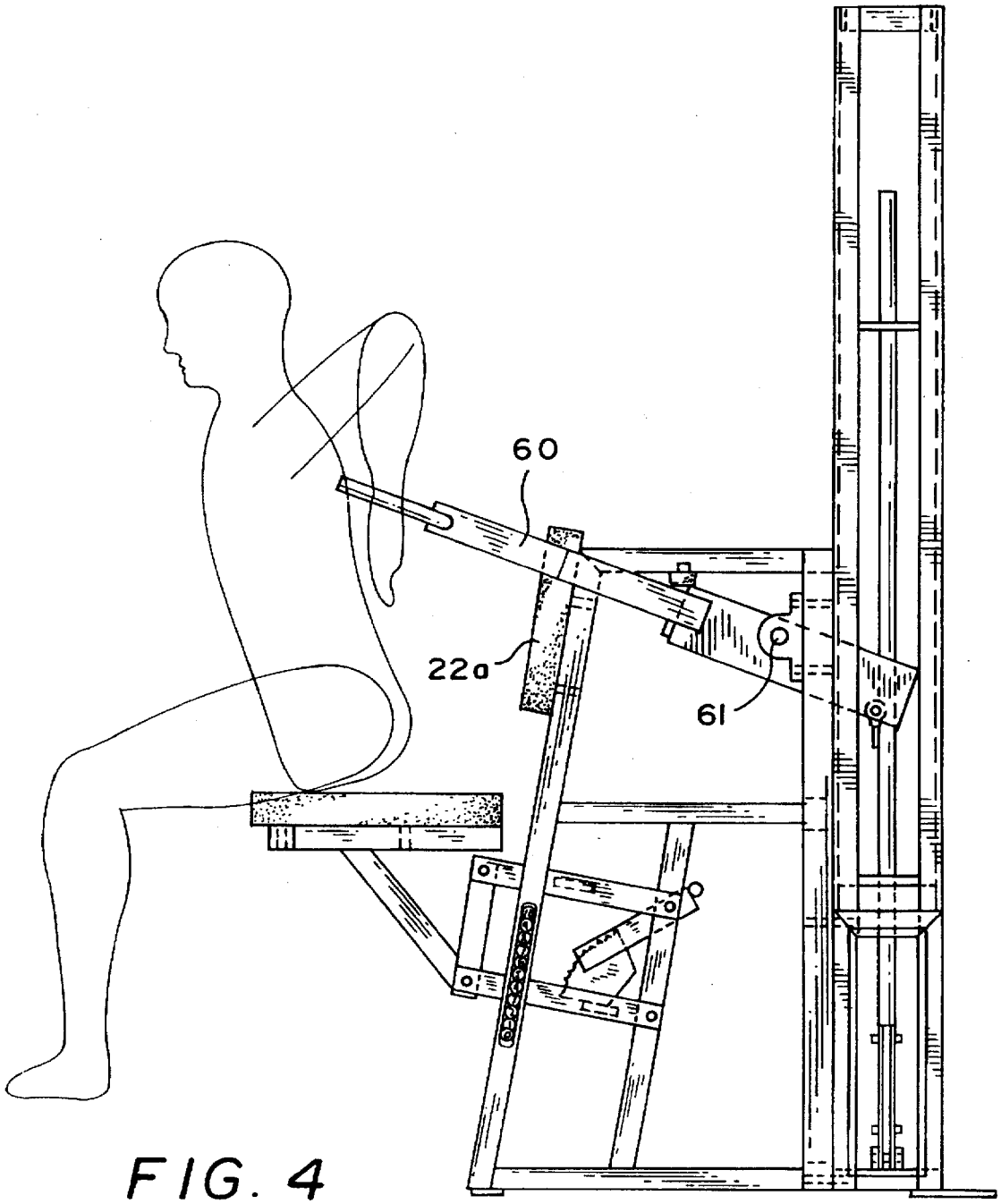
FIG. 4 is an end elevational view of a machine constituting another embodiment of the present invention.

Referring now to FIG. 4, there is shown another machine which may be termed a "seated dip" machine constituting another embodiment of the present invention which is generally similar to the machine shown in FIGS. 1 through 3 and described above. However, in the present machine the movement arm 60 is pivoted about the horizontal pivot shaft 61 at an elevation that is lower than that described above. This enables easy access to the movement arm by the user by placing the arms downwardly along the sides of the user's body thus allowing the users who do not have enough sufficient upper body strength, to perform the desired exercises.

Figure 5:
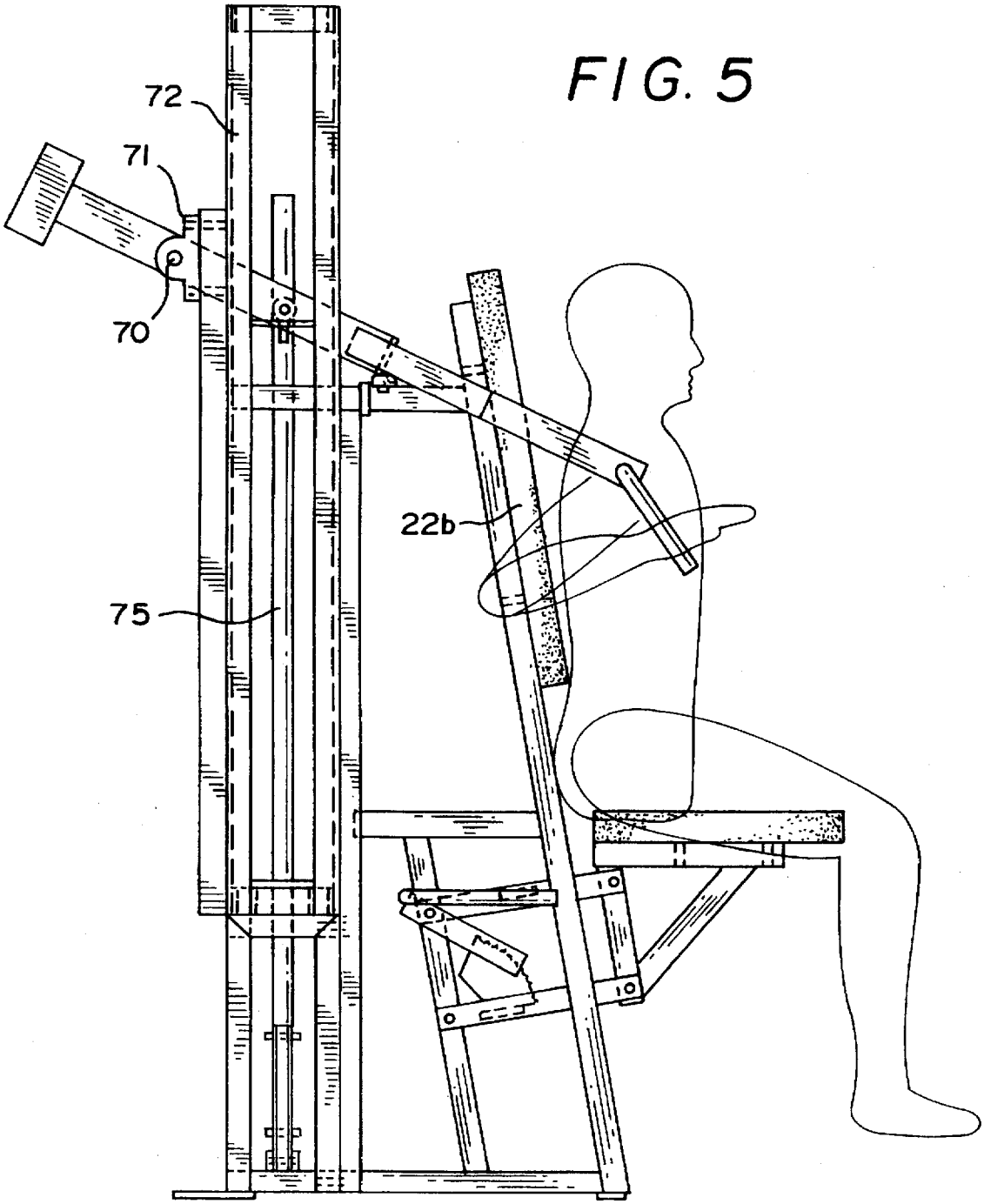
FIG. 5 is an end elevational view of another machine constituting another embodiment of the present invention.

Referring now to FIG. 5, there is shown a machine which may be termed "overhead press" machine constituting another embodiment of the present invention for exercising the upper chest, neck, shoulders and arms. In this machine the movement arm is pivoted on the horizontal pivot shaft 70 at a location rearwardly of the drive rod 75; the pivot shaft 70 being mounted in bearing blocks 71 secured to the frame as shown in FIG. 5. To perform the exercise with the present machine, the movement arm is raised against the resistance of the resistance weight stack to pivot the movement arm about the shaft 70 and to raise the drive rod 75 and in turn the resistance weights. As is the case in the above described embodiments, the backrest 22*b* is angled rearwardly to allow the user to perform the exercise in a manner which will lessen the stress on the shoulders and help prevent rotary-cuff type injuries.

It will be seen that the present invention provides exercise machines with extremely low friction in the transmission between the movement arm and the weight stack thus increasing the efficiency of the machine. In addition, the height of the machine of the present invention may be reduced. Furthermore, the machine of the present invention allows easy use of the machine by also affording direct access to the seat and the resistance weight stack which because of the compound weight stacks, allows weight selection in small increments, for example 2 lb. increments.

What is claimed is:

1. A machine for exercising the human body comprising in combination, a movement arm having a generally horizontal axis about which the movement arm moves upon exercising muscles of the body, a weight stack having a plurality of stacked weights connectable to said movement arm to oppose movement of said movement arm about said axis in one direction, said weight stack having a generally vertical pin movable in a generally vertical direction relative to said weights while being connectable to one of said weights, a lever located below the weight stack and pivotally connected to the pin and to the movement arm to raise the pin to lift the weight when the movement arm is rotated in said one direction, a generally vertical drive shaft connected to and between the lever and movement arm to transmit movement therebetween and a link pivotally connected to the lever on a side of the drive shaft opposite the pin of the weight stack, said link being pivotally connected to said lever at an elevation below said weights, said link being pivotally connected to a stationary frame to pivotally mount the lever to the frame.

2. The machine defined in claim 1 wherein said movement arm has one end portion adapted to be grasped by a user and wherein the horizontal axis is located between said one end portion of said movement arm and said shaft.

3. The machine defined in claim 1 wherein said link is connected to the lever at an end portion opposite an end portion of the lever where the pin is connected to the lever.

4. The machine defined in claim 1 wherein said pin has first and second groups of longitudinally spaced apertures for use in connecting two weight stacks to the pin, said weight stack including two independent groups of weights With each group being connectable to the pin independently of the other groups.

5. A machine defined in claim 1 wherein said weight stack includes a vertical frame and said stationary frame extends below said weight stack frame.

6. A machine for exercising the human body comprising in combination, a movement arm having an axis of movement about which the movement arm moves upon exercising muscles of the body, at least one weight connectable to said movement arm to oppose movement of said movement arm about said axis in one direction, a drive transmission between said movement arm and the weight including a lever connected to the weight to raise the weight when the movement arm is rotated in one direction about said axis, connecting means between said movement arm and the lever to transmit motion of said movement arm to the lever, a link pivotally connected to said lever and pivotally connected to a stationary support to mount the lever to said support, and wherein said movement arm is located above said lever and wherein said weight is included in a weight stack having a generally vertical pin movable relative to said weight, said weight being connectable to said pin to move with the pin, and wherein said lever is pivotally connected to the pin below the weight.

7. The machine defined in claim 6 wherein said connecting means includes a shaft pivotally connected to said lever at a location between the pin and the pivotal connection of the lever to the link.

8. The machine defined in claim 6 wherein said connecting means includes a shaft directly connected at one end to the movement arm and directly connected at its opposite end to the lever.

9. The machine defined in claim 8 wherein said movement arm is pivotally mounted at said generally horizontal axis at a location intermediate the ends of said movement arm, said movement arm having on one side of said axis means for grasping said movement arm to pivot the movement arm about said axis, and wherein said shaft is pivotally connected to said movement arm on the opposite side of said horizontal axis.

10. A machine defined in claim 6 further including a weight stack frame including said weight, and a support frame including said stationary support and located below said weight stack frame.

11. A machine defined in claim 10 wherein said link is pivotally connected to said support frame and is pivotally connected to said lever at an elevation below said weight stack and within confines of said support free.

12. A machine for exercising the human body comprising in combination, a movement arm to be moved about an axis upon exercising muscles of the body, a weight connectable to the movement arm to oppose movement of the movement arm about said axis in one direction, and drive transmission means between said weight and said movement arm including a lever located below and pivotally connected to the weight to lift the weight when the movement arm moves in said one direction, and a link pivotally connected to said lever and pivotally mounted to a fixed support to allow the lever to undergo translatory movement relative to the fixed support.

* * * * *